US008405478B1

(12) United States Patent
Dai

(10) Patent No.: US 8,405,478 B1
(45) Date of Patent: Mar. 26, 2013

(54) LOW LOSS MAGNETIC CORE

(75) Inventor: George Shengshi Dai, Sunnyvale, CA (US)

(73) Assignee: Marvell International Ltd., Hamilton (BM)

( * ) Notice: Subject to any disclaimer, the term of this patent is extended or adjusted under 35 U.S.C. 154(b) by 470 days.

(21) Appl. No.: 12/614,843

(22) Filed: Nov. 9, 2009

Related U.S. Application Data

(60) Provisional application No. 61/122,526, filed on Dec. 15, 2008.

(51) Int. Cl.
*H01F 3/00* (2006.01)

(52) U.S. Cl. ..... 335/297; 335/281

(58) Field of Classification Search ..... 335/296–298, 335/281, 282; 336/212, 233, 234, 178
See application file for complete search history.

(56) References Cited

U.S. PATENT DOCUMENTS 2,300,964 A * 11/1942 Putman ..... 336/217
3,878,495 A * 4/1975 Thomas ..... 336/212
2008/0071260 A1* 3/2008 Shores ..... 606/34

* cited by examiner

*Primary Examiner* — Elvin G Enad
*Assistant Examiner* — Lisa Homza

(57) ABSTRACT

A magnetic core including (i) a first magnetic material having a first magnetic permeability to substantially provide a core body of the magnetic core, and (ii) a second magnetic material having a substantially triangular structure positioned in a corner region of the core body. The corner region is defined by a region of the core body where a first portion of the core body coincides with a second portion of the core body in a manner that is substantially perpendicular. The second magnetic material is used to substantially evenly distribute magnetic flux in the magnetic core, and the second magnetic material has a second magnetic permeability that is lower than the first magnetic permeability.

16 Claims, 4 Drawing Sheets

LOW LOSS MAGNETIC CORE

CROSS REFERENCE TO RELATED APPLICATIONS

The present application claims priority to U.S. patent application Ser. No. 61/122,526 filed Dec. 15, 2008, the entire specification of which is hereby incorporated by reference in its entirety for all purposes, except for those sections, if any, that are inconsistent with this specification.

TECHNICAL FIELD

Embodiments of the present invention relate to magnetic cores, and more particularly, to increasing energy efficiency of magnetic cores.

BACKGROUND

A magnetic core is a component in a variety of electrical and electromechanical devices including, for example, power, generators, motors, transformers or inductors and can be found in devices such as Power Generation Sites, transformer substations, power supplies, direct current (DC) converters, refrigerators, air conditioners, vacuum cleaners, fluorescent lamps, and/or electrical cars, as well as a host of other devices. The magnetic core can be used, for example, to concentrate the strength and increase the effect of magnetic fields produced by electric currents and magnets.

FIG. 1 schematically illustrates unevenly distributed magnetic flux 102 in an example magnetic core 100. The magnetic flux 102 is generally more highly concentrated near the inner corner regions 104. The unevenly distributed flux 102 may result in additional generated heat at the corners, which may produce unwanted power loss and/or reduced energy efficiency. The unevenly distributed magnetic flux 102 may be apparent in a variety of cores including gaped/un-gaped magnetic cores or magnetic cores having other shapes or configurations. Magnetic flux is generally concentrated near the higher curvature radius of magnetic core structures resulting in unwanted power loss. For example, a toroid-shaped magnetic core generally has concentrated magnetic flux near an inner radius of the toroid compared to an outer radius of the toroid.

SUMMARY

In various embodiments, the present disclosure provides a magnetic core comprising a first magnetic material having a first magnetic permeability to substantially provide a core body of the magnetic core and a second magnetic material having a substantially triangular structure positioned in a corner region of the core body, the corner region being defined by a region of the core body where a first portion of the core body coincides with a second portion of the core body in a manner that is substantially perpendicular, wherein the second magnetic material is used to substantially evenly distribute magnetic flux in the magnetic core, and wherein the second magnetic material has a second magnetic permeability that is lower than the first magnetic permeability.

In various embodiments, the present disclosure further provides a magnetic core comprising a first magnetic material having a first magnetic permeability to substantially provide a toroid-shaped core body of the magnetic core and a second magnetic material having a substantially triangular structure positioned in the core body, the second magnetic material being used to substantially evenly distribute magnetic flux in the magnetic core, wherein the second magnetic material has a second magnetic permeability that is lower than the first magnetic permeability.

In various embodiments, the present disclosure further provides a method of providing a first magnetic material having a first magnetic permeability to substantially form a core body of a magnetic core and placing a second magnetic material having a second magnetic permeability and having a substantially triangular structure into the core body to substantially evenly distribute a magnetic flux in the magnetic core, wherein the second magnetic permeability is lower than the first magnetic permeability.

BRIEF DESCRIPTION OF THE DRAWINGS

Embodiments of the present invention will be readily understood by the following detailed description in conjunction with the accompanying drawings. To facilitate this description, like reference numerals designate like structural elements. Embodiments of the invention are illustrated by way of example and not by way of limitation in the figures of the accompanying drawings.

DETAILED DESCRIPTION OF EMBODIMENTS OF THE INVENTION

The present specification describes configurations and techniques to provide a low loss magnetic core. In the following detailed description, reference is made to the accompanying drawings which form a part hereof wherein like numerals designate like parts throughout, and in which is shown by way of illustration embodiments in which the invention may be practiced. In general, other embodiments may be utilized and structural or logical changes may be made without departing from the scope of the present invention. Therefore, the following detailed description is not to be taken in a limiting sense, and the scope of embodiments in accordance with the present invention is defined by the appended claims and their equivalents.

The description may use the phrases "in an embodiment," or "in embodiments," which may each refer to one or more of the same or different embodiments. The phrase "in some embodiments" is used repeatedly. The phrase generally does not refer to the same embodiments; however, it may. The terms "comprising," "having," and "including" are synonymous, unless the context dictates otherwise. The phrase "A and/or B" means (A), (B), or (A and B). The phrase "A/B" means (A), (B), or (A and B), similar to the phrase "A and/or B." The phrase "at least one of A, B and C" means (A), (B), (C), (A and B), (A and C), (B and C) or (A, B and C). The phrase "(A) B" means (B) or (A and B), that is, A is optional.

Figure 2A:
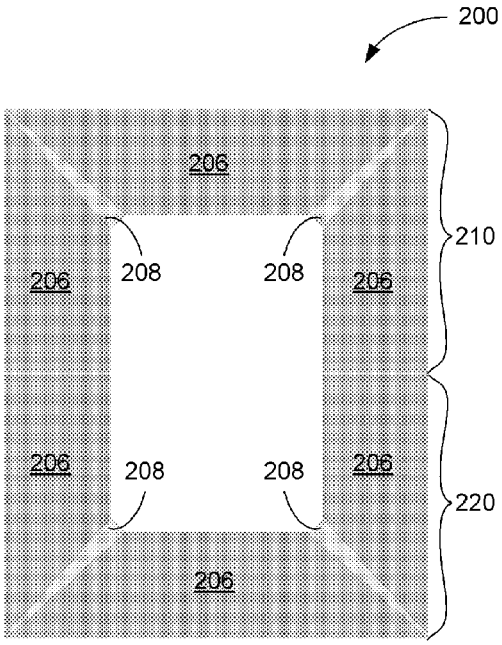
FIG. 2*a* schematically illustrates an example magnetic core, in accordance with various embodiments.

FIG. 2*a* schematically illustrates an example magnetic core 200, in accordance with various embodiments. The illustrated magnetic core 200 comprises a first U-core 210 and a second U-core 220, coupled as shown. In accordance with various embodiments, a magnetic core may include a variety of other shapes and configurations than what is depicted including, for example, C-cores, E-cores, I-cores, toroids, cylinders, rings, beads, planar cores, or other shapes and configurations that may benefit from the principles described herein.

The magnetic core 200 comprises a first magnetic material 206 having a first magnetic permeability to substantially provide a core body of the magnetic core 200. The first magnetic material 206 includes, for example, soft or hard magnetic materials with high magnetic permeability such as soft ferrite, laminated silicon steel, and/or powder iron, or any other magnetic material that may benefit from the principles described herein. The core body generally includes components (e.g., first magnetic material 206 and second magnetic material 208) of the magnetic core 200 that comprise magnetic material to concentrate the strength and/or increase the effect of magnetic fields applied to the magnetic core 200.

The magnetic core 200 further comprises a second magnetic material 208 having a second magnetic permeability that is lower than the first magnetic permeability of the first magnetic material 206. The second magnetic material 208 may be coupled to or positioned in the core body in a manner that substantially evenly distributes magnetic flux in the magnetic core 200. In other words, the magnetic core 200 having the second magnetic material 208, coupled as shown, generally has a more evenly distributed magnetic flux than a magnetic core that solely comprises the first magnetic material 206.

Figure 2B:
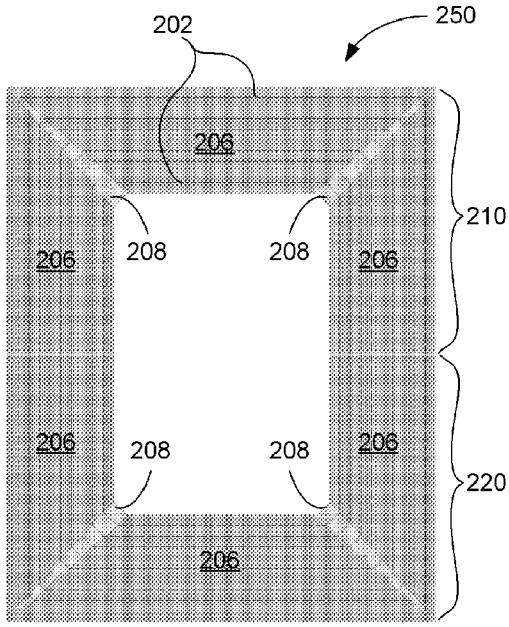
FIG. 2*b* schematically illustrates a substantially evenly distributed magnetic flux in an example magnetic core, in accordance with various embodiments.

FIG. 2*b* schematically illustrates a substantially evenly distributed magnetic flux 202 in an example magnetic core 250, in accordance with various embodiments. The second magnetic material 208 forces a more even distribution of the magnetic flux 202 at the inner corners and the rest of the magnetic core 250 by making a magnetic reluctance associated with different loops or paths of the magnetic flux 202 more similar or substantially the same. In other words, the second magnetic material 208 is generally configured in the core body to provide similar or substantially equal reluctance for different loops of the magnetic flux 202. For example, a magnetic reluctance for an inner loop of the magnetic flux 202 that is closer to the inner corners of the magnetic core 250 may be similar or substantially equal to a magnetic reluctance for an outer loop of the magnetic flux 202 that is closer to the outer corners of the magnetic core 250.

Figure 1:
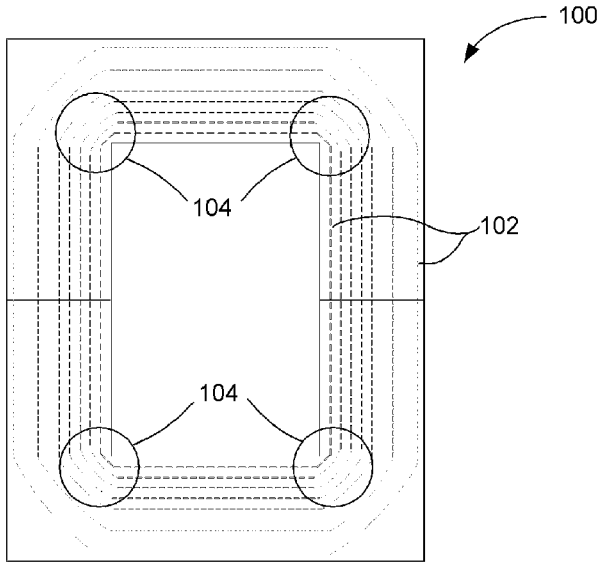
FIG. 1 (PRIOR ART)
FIG. 1 schematically illustrates unevenly distributed magnetic flux in an example magnetic core.

Coupling a lower permeability magnetic material such as the second magnetic material 208 to the first magnetic material 206, as shown, generally reduces or substantially eliminates the localized heating and/or power loss described with respect to the inner corner regions 104 of FIG. 1 and provides a more energy efficient magnetic core 250. Example design principles for the shape and configuration of the second magnetic material 208 are described with respect to FIGS. 3-5.

Figure 3:
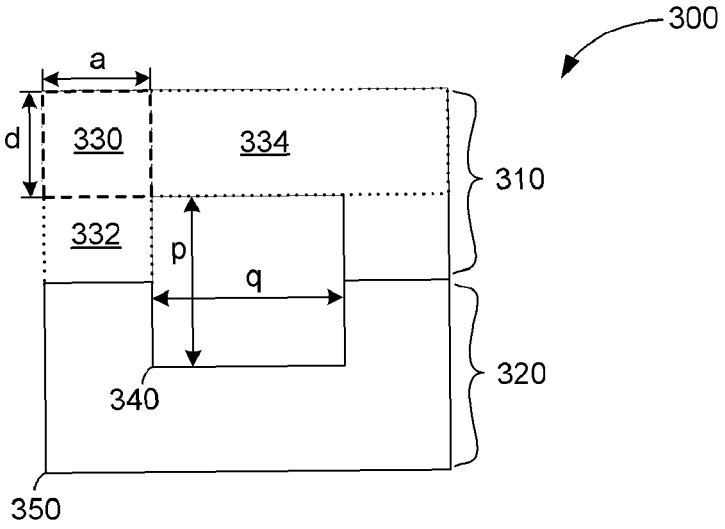
FIG. 3 schematically illustrates a corner region of an example magnetic core, in accordance with various embodiments.

FIG. 3 schematically illustrates a corner region 330 of an example magnetic core 300, in accordance with various embodiments. The magnetic core 300 comprises a first U-core 310 and a second U-core 320, coupled as shown. The magnetic core 300 further includes a corner region 330 defined by a region of the core body where a first portion 332 of the core body meets or coincides with a second portion 334 of the core body in a manner that is substantially perpendicular. The first portion 332 of the U-core 310, for example, coincides with the second portion 334 at the corner region 330 in a manner that roughly forms a right angle where the first portion 332 and the second portion 334 meet. According to various embodiments, the components of the magnetic core 300 may have rounded edges and/or corners without departing from the scope of this disclosure.

The corner region 330 has an area of about a×d or slightly larger, where a is a width of the first portion 332 and where d is a width of the second portion 334, as illustrated. An inner perimeter 340 of the magnetic core 300 generally represents a shortest path for magnetic flux and an outer perimeter 350 generally represents a longest path for magnetic flux. The shortest magnetic flux path around the inner perimeter 340 has a distance equal to 2p+2q, where p and q represent the illustrated dimensions associated with the inner perimeter 340. The longest magnetic flux path around the outer perimeter 350 has a distance equal to 4a+4d+2p+2q. An evenly distributed flux can be obtained in the magnetic core 300 by making reluctance for the longest path, the shortest path, and paths in between, substantially similar. The same reluctance for the various paths (e.g., inner perimeter 340 and outer perimeter 350) may be achieved by coupling a lower permeability material at one or more corner regions such as the corner region 330 of the magnetic core 300. An example configuration for coupling a lower permeability material at the corner region 330 is described further with respect to FIG. 4.

Figure 4:
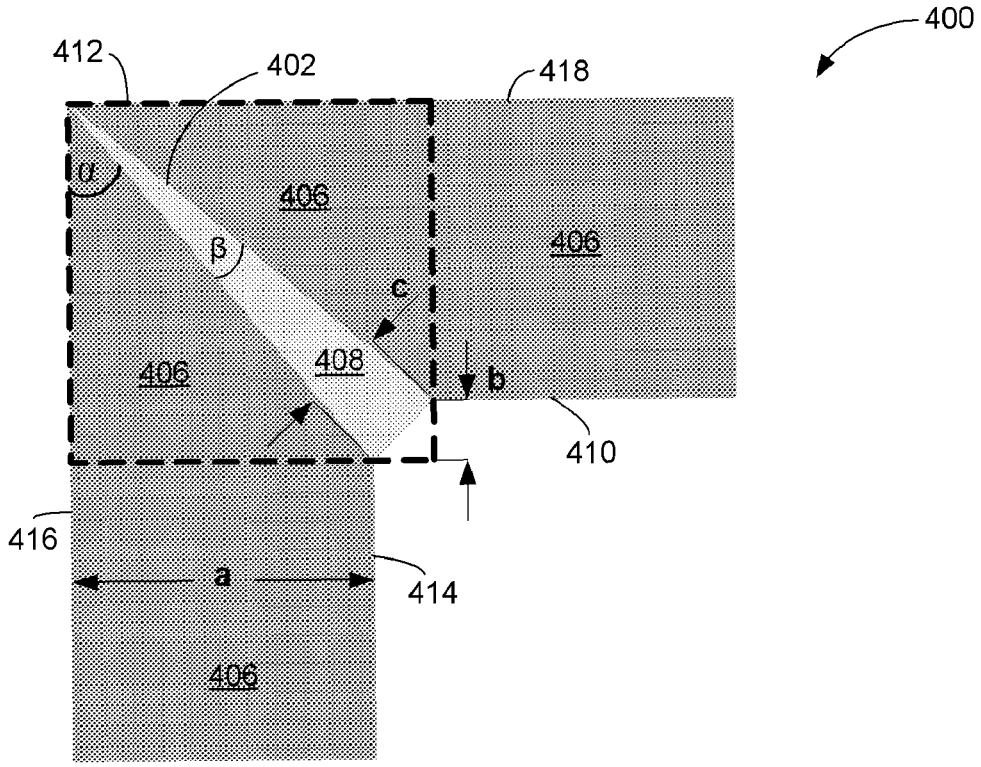
FIG. 4 schematically illustrates an example triangular structure coupled to a core body at a corner region of a magnetic core, in accordance with various embodiments.

FIG. 4 schematically illustrates an example triangular structure 402 coupled to a core body 400 at a corner region 412 (e.g., 330) of a magnetic core (e.g., magnetic core 200 or magnetic core 300), in accordance with various embodiments. The term "coupled to" as used with respect to the triangular structure 402 broadly includes connection relationships such as "physically connected to" or "part of", meaning that the triangular structure 402 may be "formed in", "positioned in", "placed in", or "inserted in" the core body, or other similar meanings. As alluded to earlier, the core body 400 includes a first magnetic material 406 having a first magnetic permeability. The corner region 412 includes the triangular structure 402 comprising a second magnetic material 408 having a second magnetic permeability that is lower than the first magnetic permeability.

According to various embodiments, the triangular structure 402 may be only substantially triangular in form. In other words, the triangular structure 402 may not be an exact triangle, but may include triangular structures having rounded corners, uneven sides, or other deviations from a triangular shape. The term triangular structure 402 is intended to describe a general shape of the second magnetic material 408.

In an embodiment, the triangular structure 402 is an isosceles triangle having a base with length, c, that is positioned near an inner corner of the corner region 412 and having an apex that is positioned near an outer corner of the corner region 412, as illustrated. The base having length, c, may form an angle that is substantially 45° relative to an inner surface (e.g., 410, 414) of the core body 400. An angle, α, defines the angle between an outer surface (e.g., 416, 418) of the first magnetic material 406 and the substantially triangular structure 402, as illustrated.

Distance, b, defines a distance that is normal to an inner surface (e.g., 410) and spans from the inner surface of the first magnetic material 406 to a position where an end of the base having length, c, coincides with an inner surface 414 that is substantially perpendicular to the other inner surface 410, as depicted. The distance, b, may be determined according to the following equation, where a is a width of a portion of the core body 400, cot represents a cotangent function, and where α defines the angle between the outer surface (e.g., 416, 418) of the first magnetic material 406 and the substantially triangular structure 402, as illustrated:

$$b=a*\cot(\alpha)-a=a(\cot(\alpha)-1) \quad (1)$$

For clarity and ease of discussion of the principles described herein, the core body 400 will be described for an example case where distance a of FIG. 3 is equal to distance d of FIG. 3. In such a case, within the corner region 412, the longest distance for magnetic flux is through the first magnetic material 406 around the outer perimeter (e.g., 2a) of the core body 400 and the shortest distance for magnetic flux is across the base length (e.g., c) of the triangular structure 402 comprising the second magnetic material 408. The following equations set the shortest path (e.g., c) reluctance to be the same as the longest path reluctance (e.g., 2a), and provide a way to calculate the angle α, where $S_{unit_area}$ is a unit cross-section area of the magnetic flux, $\mu_1$ is the magnetic permeability of the first magnetic material 406, and $\mu_2$ is the magnetic permeability of the second magnetic material 408.

$$\frac{2a}{S_{unit_area}\mu_1}=\frac{\sqrt{2}\,a(\cot(\alpha)-1)}{S_{unit_area}\mu_2} \quad (2)$$

becomes $$\cot(\alpha)=\frac{\sqrt{2}\,\mu_2+\mu_1}{\mu_1} \quad (3)$$

becomes $$\alpha=\cot^{-1}\left(\frac{\sqrt{2}\,\mu_2+\mu_1}{\mu_1}\right) \quad (4)$$

Thus, if magnetic permeability for the first magnetic material 406 and the second magnetic material 408 are known, then the angle, α, can be determined. In an embodiment, the first magnetic material 406 comprises ferrite and the second magnetic material 408 comprises iron powder. Subject matter is not limited in this regard, and the first and second magnetic materials (e.g., 406, 408) may include any of a variety of magnetic materials that may benefit from the principles described herein. The base length, c, can be determined according to the following:

$$c=\sqrt{2}\alpha(\cot(\alpha)-1) \quad (5)$$

Equation (5) is reduced to the following using equation (4):

$$c=\frac{2a\mu_2}{\mu_1} \quad (6)$$

An angle, β, of the apex of the triangular structure 402 may be determined according to the following:

$$\beta=90°-2\alpha \quad (7)$$

A triangular structure 402 may be implemented in core bodies having other shapes and the triangular structure 402 may be positioned in regions other than the corner region 412 of the core body, according to various embodiments. Such an example is described further with respect to FIG. 5*a*.

Figure 5A:
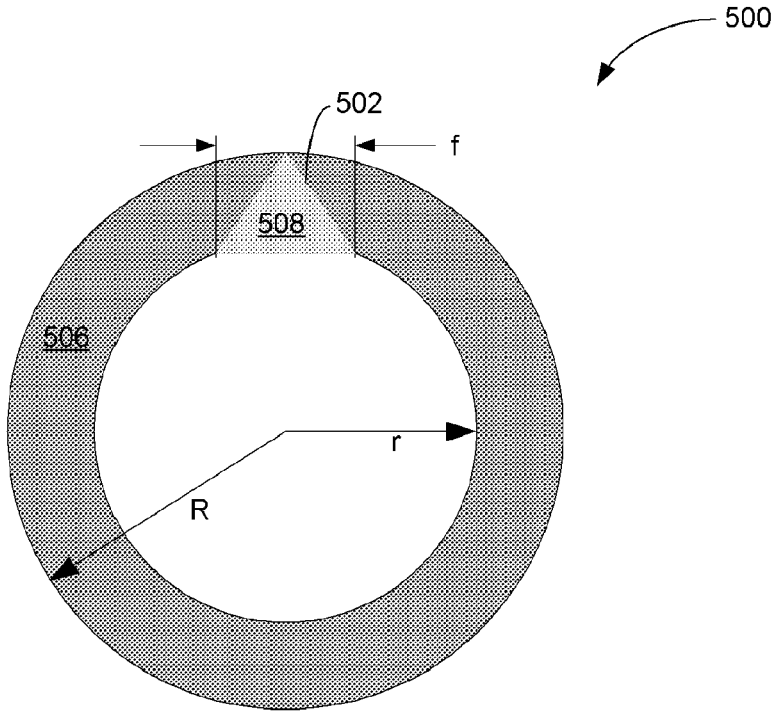
FIG. 5*a* schematically illustrates an example triangular structure coupled to a core body of a toroid-shaped magnetic core, in accordance with various embodiments.

FIG. 5*a* schematically illustrates an example triangular structure 502 coupled to a core body of a toroid-shaped magnetic core 500, in accordance with various embodiments. The magnetic core 500 includes a first magnetic material 506 having a first magnetic permeability and a second magnetic material 508 having a second magnetic permeability that is lower than the first magnetic permeability.

In an embodiment, the second magnetic material 508 forms a substantially triangular structure 502 having a base positioned near an inner radius, r, of the core body and having an apex positioned near an outer radius, R, of the core body. The base length, f, may be determined according to the following, where $\mu_1$ is the magnetic permeability of the first magnetic material 506, and $\mu_2$is the magnetic permeability of the second magnetic material 508:

$$f=\frac{2\pi(R-r)\mu_2}{\mu_1-\mu_2} \quad (8)$$

The use of a triangular structure 502 in the magnetic core 500 may make magnetic reluctance the same between the inner radius, r, and the outer radius, R, which may force the magnetic flux to be evenly distributed. The same principle may be applied to other circular-type magnetic cores.

Figure 5B:
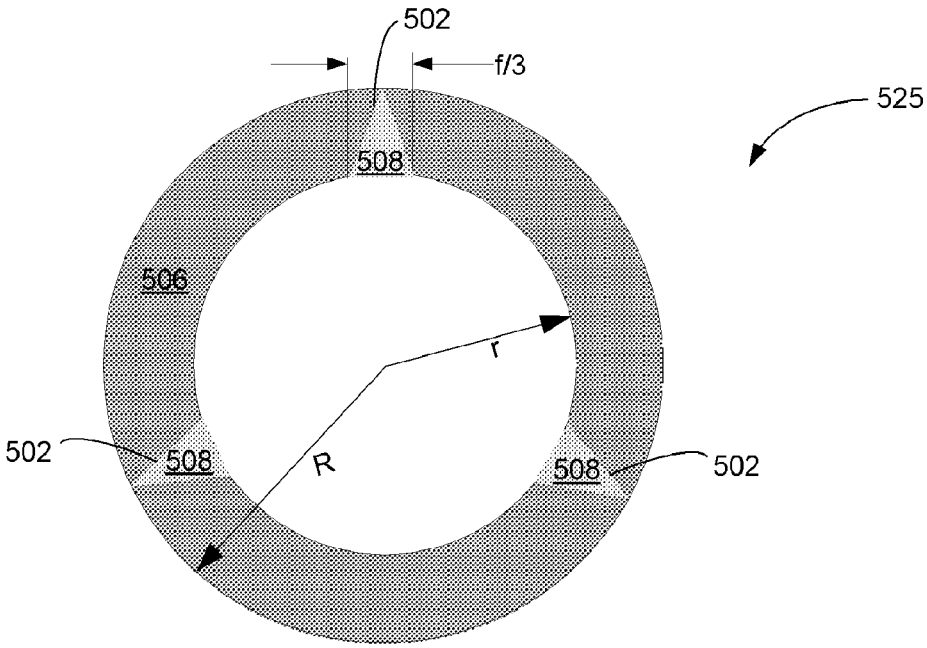
FIG. 5*b* schematically illustrates multiple example triangular structures coupled to a core body of a toroid-shaped magnetic core, in accordance with various embodiments.

FIG. 5*b* schematically illustrates multiple example triangular structures 502 coupled to a core body 506 of a toroid-shaped magnetic core 525, in accordance with various embodiments. In an embodiment, a base length for each of the multiple triangular structures 502, is determined by calculating base length, f, according to equation (8) for a single triangular structure and dividing the base length, f, by the number of triangular structures 502 used. For example, in the illustrated embodiment of FIG. 5*b*, the base length is f/3 for each of the three triangular structures 502. In a case where only two triangular structures are used (not shown), the base length for each triangular structure is f/2. In another case where only four triangular structures are used, the base length for each triangular structure is f/4.

This principle can be used to calculate the base length for any number of triangular structures used to evenly distribute magnetic flux in a circular-type magnetic core. An increasing number of triangular structures may provide more evenly distributed flux distribution, but may cost more to manufacture. A desired number of triangular structures 502 may account for these considerations.

Figure 6:
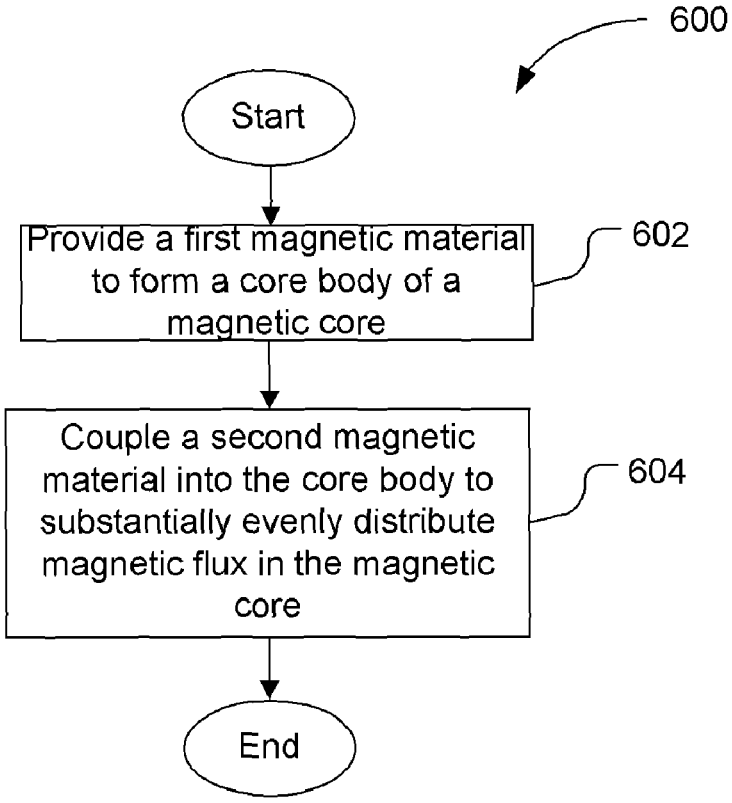
FIG. 6 is a flow diagram of a method to fabricate a magnetic core having a substantially evenly distributed magnetic flux, in accordance with various embodiments.

FIG. 6 is a flow diagram of a method to fabricate a magnetic core having a substantially evenly distributed magnetic flux, in accordance with various embodiments. At block 602, method 600 includes providing a first magnetic material to form a core body of a magnetic core. The first magnetic material comprises a first magnetic permeability and may be used to form a substantial portion of the core body. The magnetic core may be formed according to any suitable well-known process.

According to various embodiments, the first magnetic material is formed into a core of desired shape and then one or more portions of the first magnetic material are removed such that a second magnetic material may be positioned, at block 604, in the core body to substantially evenly distribute the magnetic flux in the magnetic core. In other embodiments, the first magnetic material is formed into a core having vacant regions to anticipate where the second magnetic material is to be placed, at block 604. Other suitable techniques to provide a first magnetic material to form a core body of the magnetic core may be used in other embodiments.

At block 604, a second magnetic material is coupled into the core body to substantially evenly distribute magnetic flux in the magnetic core. The term "couple" as used with respect to coupling the second material into the core body may broadly include connection relationships such as to "physically connect", "become part", "position", "place", "insert", or other similar meanings. The second magnetic material may, for example, first be formed into a triangular structure and then inserted into the core body. In another example, the triangular structure may be formed in place as part of a curing process. In an embodiment, the second magnetic material is formed into a triangular structure first, and then placed into the core body prior to a baking process that cures the magnetic core to reduce manufacturing costs.

The triangular structure may be formed to conform with design principles disclosed herein such as determining a length of a base and/or associated angles of the triangular structure. The triangular structure may be placed in a variety of structures, including a corner region or in a toroid as described herein. Such principles may be applied to other similar shapes and configurations, such as U-cores, C-cores, E-cores, I-cores, toroids, cylinders, rings, beads, planar cores, or other shapes and configurations that may benefit from principles taught in this disclosure.

Various operations may have been described as multiple discrete actions or operations in turn, in a manner that is most helpful in understanding the claimed subject matter. However, the order of description should not be construed as to imply that these operations are necessarily order dependent. In particular, these operations may not be performed in the order of presentation. Operations described may be performed in a different order than the described embodiment. Various additional operations may be performed and/or described operations may be omitted in additional embodiments.

Although certain embodiments have been illustrated and described herein, a wide variety of alternate and/or equivalent embodiments or implementations calculated to achieve the same purposes may be substituted for the embodiments illustrated and described without departing from the scope of the present invention. This application is intended to cover any adaptations or variations of the embodiments discussed herein. Therefore, it is manifestly intended that embodiments in accordance with the present invention be limited only by the claims and the equivalents thereof.

What is claimed is:

1. A magnetic core comprising:

a first magnetic material having a first magnetic permeability to substantially provide a core body of the magnetic core; and a second magnetic material having a triangular structure positioned in a corner region of the core body, wherein the corner region of the core body is defined by a region of the core body where a first portion of the core body coincides with a second portion of the core body in a manner that is substantially perpendicular, wherein the second magnetic material is used to substantially evenly distribute magnetic flux in the magnetic core, and wherein the second magnetic material has a second magnetic permeability that is lower than the first magnetic permeability of the first magnetic material.

2. The magnetic core of claim 1, wherein the triangular structure comprises an isosceles triangle, wherein the substantially isosceles triangle includes:

a base substantially disposed near an inner corner of the corner region; and an apex substantially disposed near an outer corner of the corner region.

3. The magnetic core of claim 2, wherein a length, c, of the base is determined according to the following, where $\alpha$ is a width of the first portion or the second portion of the core body, $\mu_1$ is the first magnetic permeability, and $\mu_2$ is the second magnetic permeability:

$$c = \frac{2a\mu_2}{\mu_1}.$$

4. The magnetic core of claim 2, wherein an angle, $\beta$, of the apex is determined according to $\beta=90°-2\alpha$, where $\alpha$ is an angle determined according to the following, where $\mu_1$ is the first magnetic permeability, and $\mu_2$ is the second magnetic permeability:

$$\alpha = \cot^{-1}\left(\frac{\sqrt{2}\,\mu_2 + \mu_1}{\mu_1}\right).$$

5. The magnetic core of claim 1, wherein the core body comprises a U-core, C-core, or an E-core.

6. The magnetic core of claim 1, wherein the first magnetic material comprises ferrite and wherein the second magnetic material comprises iron power.

7. The magnetic core of claim 1, wherein the second magnetic material substantially evenly distributes magnetic flux in the magnetic core by making magnetic reluctance of paths of the magnetic flux more similar.

8. A method comprising:

providing a first magnetic material having a first magnetic permeability to substantially form a core body of a magnetic core; and placing a second magnetic material into a corner region of the core body to substantially evenly distribute a magnetic flux in the magnetic core, wherein the corner region of the core body is defined by a region of the core body where a first portion of the core body coincides with a second portion of the core body in a manner that is substantially perpendicular, wherein the second magnetic material has i) a second magnetic permeability, and ii) a triangular structure, and wherein the second magnetic permeability of the second magnetic material is lower than the first magnetic permeability of the first magnetic material.

9. The method of claim 8, wherein said placing the second magnetic material is performed prior to a baking process that cures the magnetic core.

10. The method of claim 8, wherein said placing the second magnetic material into the corner region of the core body comprises placing the second magnetic material having the triangular structure into the corner region of the core body, wherein the triangular structure has a base that is substantially disposed near an inner corner of the corner region and has an apex that is substantially disposed near an outer corner of the corner region.

11. The method of claim 10, further comprising forming the triangular structure using the second magnetic material.

12. The method of claim 11, wherein said forming the triangular structure comprises determining a length, c, of the base according to the following, where $\alpha$ is a width of the first portion or the second portion of the core body, $\mu_1$ is the first magnetic permeability, and $\mu_2$ is the second magnetic permeability:

$$c = \frac{2a\mu_2}{\mu_1}.$$

13. The method of claim 11, wherein said forming the triangular structure comprises determining an angle, $\beta$, of the apex according to $\beta=90°-2\alpha$, where $\alpha$ is an angle determined according to the following, where $\mu_1$ is the first magnetic permeability, and $\mu_2$ is the second magnetic permeability:

$$\alpha = \cot^{-1}\left(\frac{\sqrt{2}\,\mu_2 + \mu_1}{\mu_1}\right).$$

14. The method of claim 8, wherein the core body comprises a substantially toroid shape, and wherein said placing the second magnetic material comprises:

placing the triangular structure into the core body, the triangular structure having a base positioned near an inner radius of the core body and having an apex positioned near an outer radius of the core body, wherein the base length, f, is determined according to the following, where r is an inner radius of the core body, R is an outer radius of the core body, $\mu_1$ is the first magnetic permeability, and $\mu_2$ is the second magnetic permeability:

$$f = \frac{2\pi(R-r)\mu_2}{\mu_1 - \mu_2}.$$

15. The method of claim 8, wherein the first magnetic material comprises ferrite, and wherein the second magnetic material comprises iron power.

16. The method of claim 8, wherein said placing the second magnetic material into the core body substantially evenly distributes the magnetic flux in the magnetic core by making magnetic reluctance of paths of the magnetic flux more similar.

* * * * *